US005524040A

United States Patent [19]

Alp et al.

[11] Patent Number: 5,524,040

[45] Date of Patent: Jun. 4, 1996

[54] HIGH ENERGY RESOLUTION, HIGH ANGULAR ACCEPTANCE CRYSTAL MONOCHROMATOR

[75] Inventors: Ercan E. Alp, Bolingbrook; Timothy M. Mooney, Westmont, both of Ill.; Thomas Toellner, Green Bay, Wis.

[73] Assignee: The United States of America as represented by the United States Department of Energy, Washington, D.C.

[21] Appl. No.: 169,656

[22] Filed: Dec. 17, 1993

[51] Int. Cl.[6] ..... G21K 1/06

[52] U.S. Cl. ..... 378/85; 378/84

[58] Field of Search ..... 378/84, 85, 145, 378/43

[56] References Cited

U.S. PATENT DOCUMENTS

| | | | |
|---|---|---|---|
| 4,567,605 | 1/1986 | Bartels | 378/85 |
| 5,199,058 | 3/1993 | Tani et al. | 378/85 X |
| 5,245,648 | 9/1993 | Kinney et al. | 378/43 |

OTHER PUBLICATIONS

Eastman et al., "Easily Tunable Monochromator for 5eV ≤ Wavelength ≤ 1000 eV Synchroton Radiation", *IBM Tech. Disclosure Bulletin,* vol. 19, No. 11, Apr. 1977, pp. 4477–4478.

Construction of a Precision Diffractometer for Nuclear Bragg Scattering at the Photon Factory in *Rev. Sci. Instrum.,* 63(1), Jan. 1992, by Ishikawa et al.

New Apparatus for the Study of Nuclear Bragg Scattering, *Nuclear Instruments and Methods in Physics Research,* A266 (1988), 329–335, by Siddons et al.

*Primary Examiner*—David P. Porta

*Attorney, Agent, or Firm*—Bradley W. Smith; Hugh Glenn; William R. Moser

[57] ABSTRACT

A 4-bounce dispersive crystal monochromator reduces the bandpass of synchrotron radiation to a 10–50 meV range without sacrificing angular acceptance. The monochromator includes the combination of an asymmetrical channel-cut single crystal of lower order reflection and a symmetrical channel-cut single crystal of higher order reflection in a nested geometric configuration. In the disclosed embodiment, a highly asymmetrically cut (α=20) outer silicon crystal (4 2 2) with low order reflection is combined with a symmetrically cut inner silicon crystal (10 6 4) with high order reflection to condition a hard x-ray component (5–30 keV) of synchrotron radiation down to the μeV-neV level. Each of the crystals is coupled to the combination of a positioning inchworm and angle encoder via a respective rotation stage for accurate relative positioning of the crystals and precise energy tuning of the monochromator.

7 Claims, 5 Drawing Sheets

HIGH ENERGY RESOLUTION, HIGH ANGULAR ACCEPTANCE CRYSTAL MONOCHROMATOR

The United States Government has rights in this invention pursuant to Contract No. 61-31-109-ENG-38 between the U.S. Department of Energy and University of Chicago representing Argonne National Laboratory.

FIELD OF THE INVENTION

This invention relates generally to an x-ray monochromator and is particularly directed to a high energy resolution, high angular acceptance crystal monochromator such as used with high energy experimental physics apparatus.

BACKGROUND OF THE INVENTION

High energy radiation such as that from x-ray undulators and multipole wigglers installed in high energy photon sources such as synchrotrons are increasingly being used in applications of ultra-monochromatic radiation in various fields of science and technology. Monochromatization of the hard x-ray component (5–30 keV) of synchrotron radiation down to the μeV-neV level may be achieved via coherent nuclear resonant scattering. This technique involves a nuclear resonant medium having a coherent response for producing an energy bandpass of μeV-to-neV. However, the nuclear resonant medium also has a non-resonant response (viz. Rayleigh scattering) which, if not suppressed, will generally overwhelm the detection system and lead to a prohibitively poor signal-to-noise ratio. Despite available techniques to suppress non-resonant scattering, it is extremely beneficial to reduce the energy bandpass of the x-ray beam as much as possible before it is incident on the nuclear resonant medium. It is possible to arrange the resonant atoms in a crystal lattice in such a way that for certain reflections only the resonant nuclei scatter in phase. Thus, a perfect sample of such a crystal can suppress a large fraction of the unwanted electron scattering.

It is well known in the prior art that high brightness undulators provide high flux in the resonant bandwidth in the form of a very low divergence beam. Thus, an appreciable portion of the intensity of the incident x-ray beam can be captured before it is made to diverge from a single crystal with a vertical divergence of only ≈25 microradians. Using dispersive geometry, researchers at Brookhaven National Laboratory have used Si(8 4 0) crystals to achieve 0.09 eV resolution with an angular acceptance of 6 microradians. However, the apparatus employed to achieve this is of considerable size, i.e., 60" high and 24" long. The divergence of x-rays coming from current radiation sources is typically on the order of 100 microradians. The divergence of x-rays from the next generation of synchrotron radiation sources such as the Advanced Photon Source at Argonne National Laboratory will be approximately 25 microradians. Current monochromators are of only limited use in capturing the full intensity of the less diverging x-rays of the next generation of high energy photon sources. A diffractometer for nuclear Bragg scattering is disclosed in "Construction of a Precision Diffractometer for Nuclear Bragg Scattering at the Photon Factory" in *Rev. Sci. Instrum.*, 63(1), January 1992, by Ishikawa et al. The disclosed diffractometer includes a nested pair of crystals in fixed relation with no energy tuning capability. A monochromator system for use in nuclear Bragg scattering is disclosed in "New Apparatus for the Study of Nuclear Bragg Scattering", *Nuclear Instruments and Methods in Physics Research*, A266 (1988), 329–335, by Siddons et al.

The present invention addresses the aforementioned limitations of the prior art by providing an x-ray monochromator employing, in combination, an asymmetrical channel-cut single crystal of lower order reflection and a symmetrical channel-cut single crystal of higher order reflection in a novel nested geometry which allows for the incident x-ray beam to be collimated by the asymmetrically cut crystal before undergoing high order reflection by the symmetrically cut crystal in an arrangement which affords precise energy tuning.

OBJECTS AND SUMMARY OF THE INVENTION

Accordingly, it is an object of the present invention to provide a high energy resolution, high angular acceptance crystal monochromator for use in nuclear Bragg scattering studies.

It is another object of the present invention to provide an x-ray monochromator employing, in combination, an asymmetrical channel-cut single crystal of low order reflection and a symmetrical channel-cut single crystal of higher order reflection in a novel nested geometry.

Yet another object of the present invention is to provide a 4-bounce dispersive crystal monochromator capable of reducing the bandpass of synchrotron radiation to a 10–50 meV level, without sacrificing angular acceptance, and which is also capable of precise energy tuning.

The present invention comprises a highly asymmetrically cut ($\alpha$=20) outer silicon crystal (4 2 2), with low order reflection combined with a symmetrically cut inner silicon crystal (10 6 4), with high order reflection. The asymmetrically cut crystal collimates the diverging x-rays, while the symmetrically cut crystal reduces the energy bandpass. Compactness and high resolution are achieved by combining the asymmetrically and symmetrically cut crystals in a novel "nested" geometry, so that the beam is collimated by the asymmetrically cut crystals before undergoing high order reflection by the symmetrically cut crystals. Rotational displacement drives coupled to the two crystals permit precise energy tuning of the monochromator. The nested monochromator was designed for use with high energy synchrotron radiation sources, but also has application in anomalous diffraction studies of atomic structure of large molecules like protein crystals, anomalous small angle scattering studies, and inelastic x-ray scattering from polymers and biological systems.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
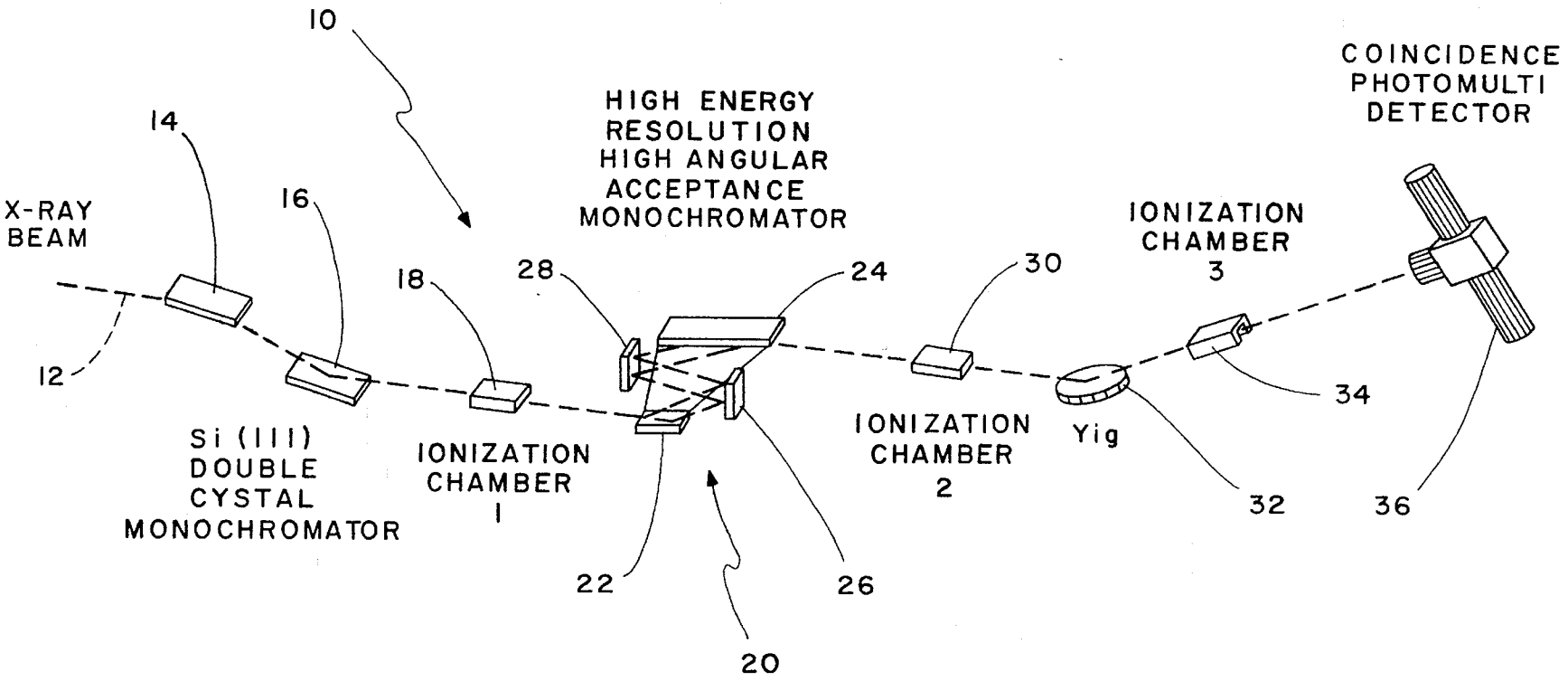
FIG. 1 is a simplified schematic diagram of a nuclear Bragg scattering analysis arrangement incorporating the high energy resolution x-ray monochromator of the present invention.

The high brightness of undulators provide high flux in the resonant bandwidth in the form of a very low divergence beam. This low divergence (vertical divergence ≈5 arcsec) makes high resolution ($\Delta E/E \approx 10^{-6}$) monochromatization in the hard x-ray regime with single crystal silicon practicable. The reason for this is essentially that the beam divergence of these insertion devices approaches the Darwin width of single crystal reflections. As a result, an appreciable fraction of the diverging x-rays in the resonant bandwidth can be accepted.

In order to construct such a crystal monochromator with large angular acceptance and high resolution, the requirements for these characteristics will now be examined. The energy resolution for Bragg diffraction from a perfect crystal can be approximated by $\Delta E/E \approx \Delta\Theta \cot\Theta_B$, where $\Theta_B$ is the Bragg angle and $\Delta\Theta$ is the incident divergence. From the theory of dynamic diffraction of x-rays from perfect crystals, the angular acceptance for a monochromatic beam is the Darwin width, which for symmetrically cut crystals is given by:

$$\Delta\theta_s = \frac{2}{\sin 2\theta} \frac{r_e \lambda^2}{\pi V} C|F_H| e^{-M} \quad \text{[Eq. 1]}$$

where, $r_e$=classical electron radius, $\lambda$=wavelength, $\Theta_B$=Bragg angle, V=unit cell volume, C=1 for σ-polarized radiation, $|F_H|$=structure factor in the scattering direction, and $e^{-M}$=Debye-Waller factor.

Typically, an attempt to achieve energy resolution is made with large Bragg angle reflections, since in this case $\cot(\Theta_s)$ becomes small. The problem with this strategy is that the Darwin width also becomes small at higher Bragg angles (unless $\Theta_s \geq 80$, where $\Theta_s$ increases substantially). Thus, although reasonably good energy resolution is achievable, the beam divergence that can be accepted is exceedingly small. To circumvent this problem, the beam divergence must be reduced to accommodate the narrow acceptance of the higher order reflections. This can be accomplished through the use of asymmetrically cut crystals.

By cutting a crystal at an angle (α) with respect to the diffracting planes, the angular acceptance becomes:

$$\Delta\Theta_a = \Delta\Theta_s / b \quad \text{[Eq. 2]}$$

where $$b = \sin(\Theta_B - \alpha)/\sin(\Theta_B + \alpha) \quad \text{[Eq. 3]}$$

It should be noted that the incident x-rays and the exiting x-rays see opposite asymmetry angles. As a result, the angular acceptance of the incident x-rays will increase, while the allowed divergence of the exiting x-rays will decrease with respect to $\Delta\Theta_s$. Thus, an asymmetrically cut crystal has a collimating effect which may be used in combination with a high order reflection to provide high energy resolution with an increased angular acceptance. Then, an optimal combination of Bragg reflections, asymmetry angle, and relative orientation to achieve the desired acceptance and resolution must be determined. For this, DuMond diagrams offer a convenient, graphic means of studying the effect of a multiple crystal diffracting system.

Referring to FIG. 1, there is shown a simplified schematic diagram of a radiation detection system 10 incorporating a monochromator 20 in accordance with the principles of the present invention. In the radiation detection system 10, an x-ray beam 12 (shown in dotted-line form) is directed through first and second crystals 14, 16 forming a Si(1 1 1) double crystal monochromator and then through a first ionization chamber 18. In the test set-up, the 24-pole wiggler on the F-2 beam line at the Cornell High Energy Synchrotron Source (CHESS) was used. X-rays from the wiggler were apertured to 6.3 arc seconds vertical divergence before impinging on the water cooled silicon (1 1 1) heat-loaded double crystal monochromator to bring the energy bandpass down to ≈5 eV. After passing through the first ionization chamber 18, the beam was then passed through the high energy resolution x-ray monochromator 20 of the present invention before passing through a second ionization chamber 30 and impinging on the nuclear resonant medium, an $^{57}$Fe enriched Yttrium Iron Garnet (YIG) crystal 32. Finally, the diffracted beam from the YIG crystal 32 is measured using a fast coincidence photo-multiplier detector 36.

Figure 2:
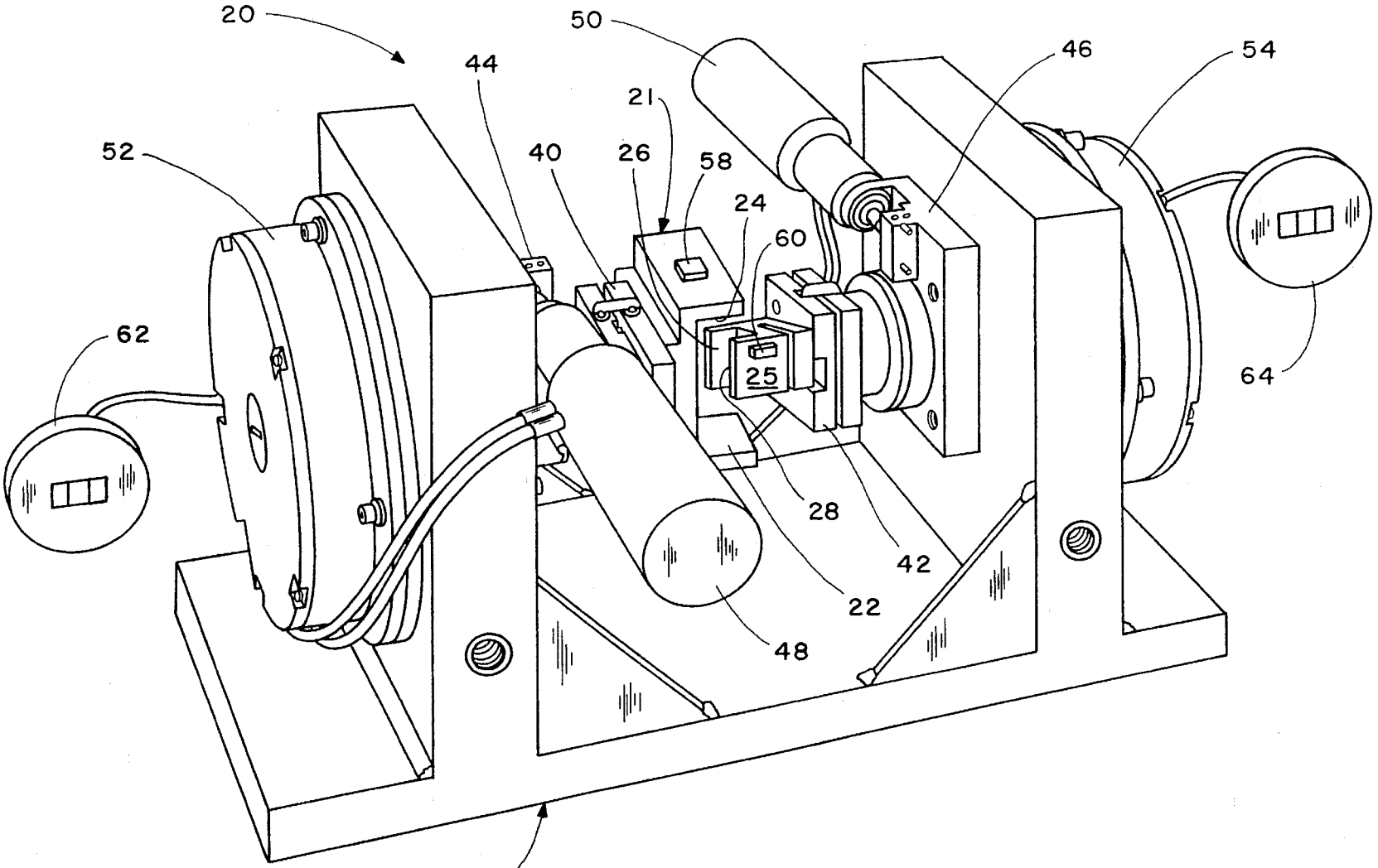
FIG. 2 is a perspective view of the x-ray monochromator of the present invention.
Figure 3:
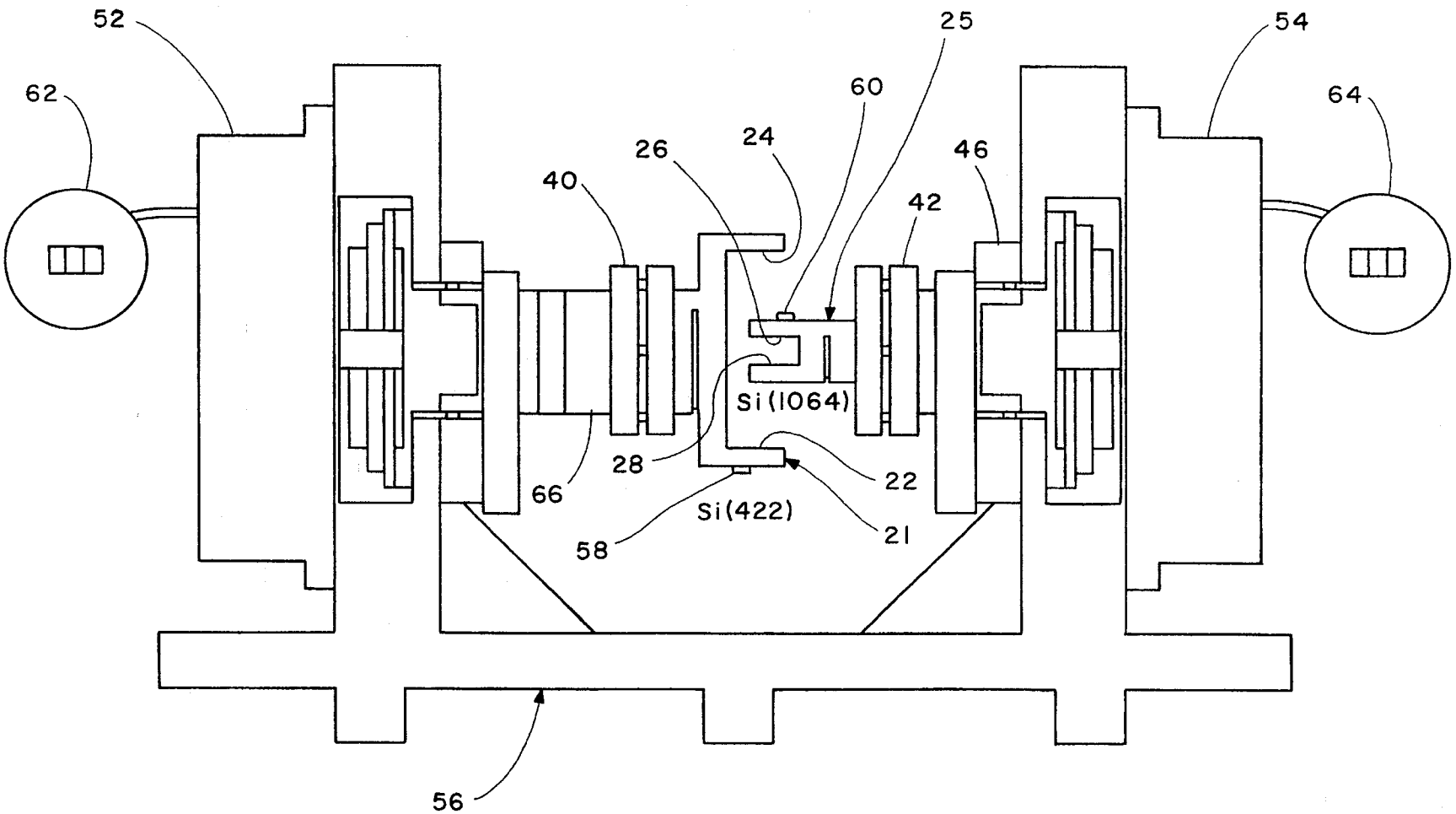
FIG. 3 is a front elevation view of the x-ray monochromator of FIG. 2.
Figure 4:
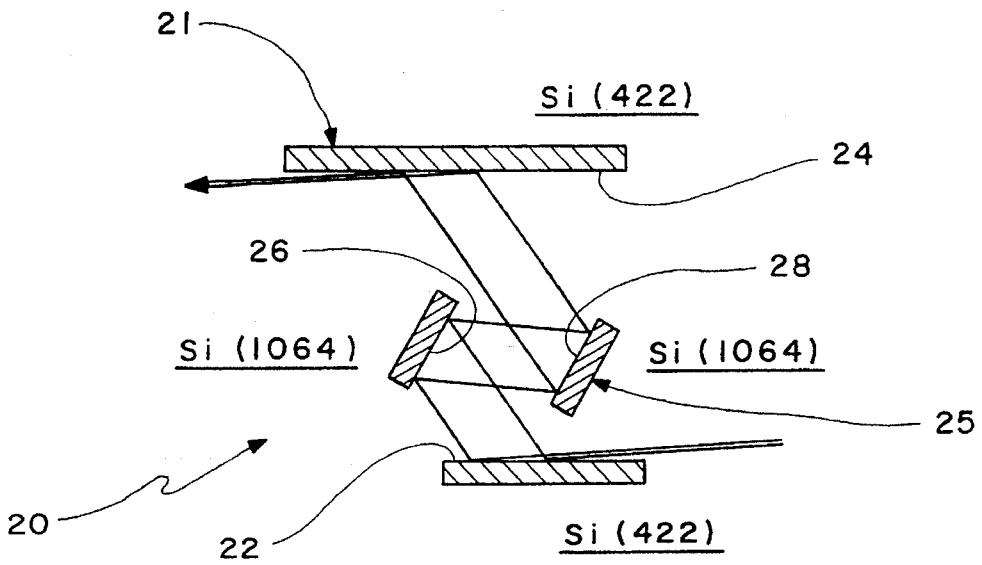
FIG. 4 is a simplified sectional view illustrating the positions and relative orientation of a symmetrically-cut silicon crystal nested within an asymmetrically-cut silicon crystal in the x-ray monochromator of the present invention.

Referring to FIGS. 2 and 3, there are respectively shown perspective and front elevation views of the high energy resolution x-ray monochromator 20 of the present invention. A simplified sectional view of the nested pair of crystals within monochromator 20 is shown in FIG. 4.

Monochromator 20 includes a first outer asymmetrically cut silicon crystal 21 having facing inner reflecting surfaces 22 and 24. The first outer silicon crystal is of the (4 2 2) type having a channel cut therein to form the first and second reflecting surfaces 22 and 24. The second inner symmetrically cut silicon crystal 25 is disposed within the channel formed in the first outer silicon crystal 21 and includes first and second facing inner reflecting surfaces 26 and 28. The second silicon crystal 25 is asymmetrically cut (α=20) and is of the (10 6 4) type. The first and second silicon crystals 21 and 25 are arranged in a nested configuration to form a (+m,+n,−n,−m) dispersive geometry as shown in FIG. 4. This design produces an incident angular acceptance of 4.5" and an energy bandpass of 11.7 meV.

The asymmetry angle of the first outer silicon crystal 21 was selected based upon a number of criteria. Although angular acceptance was the primary concern, the required alignment between the two channel-cuts in the respective crystals, the effect of too large an asymmetry angle, as well as the overall size of the monochromator 20 were considered as well. The required alignment between the channel-cuts in the respective silicon crystals is dictated by the exiting divergence of the first face and the Darwin width of the second face, i.e., the (10 6 4) crystal. A larger asymmetry angle gives rise to a more restrictive rotational alignment.

Large asymmetry angles have another side effect. As $\alpha$ approaches $\Theta$, the incident beam becomes glancing and the loss due to diffuse scattering from a rough surface increases. To avoid this, the following condition was established:

$$\Theta-|\alpha|>2. \quad \text{[Eq. 4]}$$

Figure 5:
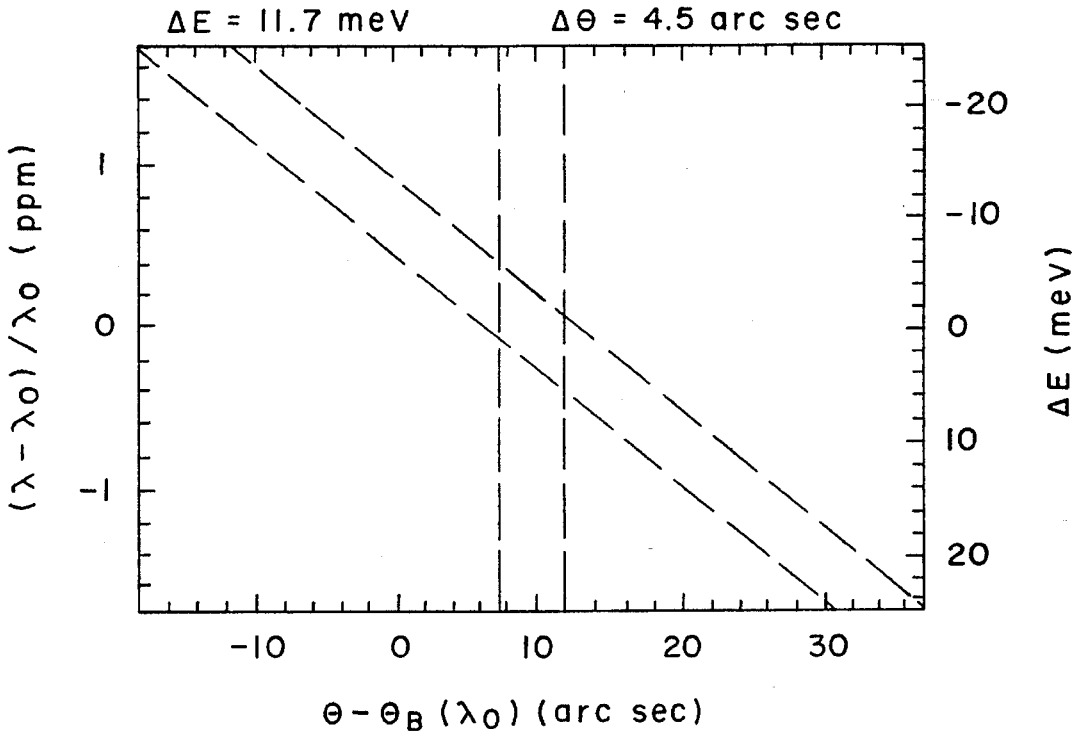
FIG. 5 is a DuMond diagram for the crystal arrangement of FIG. 4 at E =14.413 keV.

Also, as the asymmetry angle increases, the size of the diffracted beam increases as $S_{Diff}=S_{Inc}/b$. As a result, the nested channel cuts must be made larger to accommodate the diffracted beam and this, in turn, results in an increase in the overall size of the monochromator. The selected asymmetry angle reflects a consideration of all of these effects. The result is depicted graphically in the DuMond diagram of FIG. 5 for E=14.413 keV. From a transformation of this DuMond plot into the coordinates of the beam incident on the second face, the required rotational alignment between the two crystals was determined to be 0.34 arc seconds for each of the first and second crystals 21,25. To direct a beam of the correct energy through the crystal pair, angular resolution and stability of a factor of 5 or more than illustrated in FIG. 5 is required.

The inventive monochromator 20 includes a stainless steel support frame 56 to which are mounted first and second piezo electric, inchworm-driven rotation stages 44 and 46 with angular resolutions of roughly 0.02 arc seconds. In the disclosed embodiment, Burleigh model RS-75 rotation stages are employed. The first and second rotation stages 44, 46 are respectively coupled to first and second inchworms 48 and 50 and are further coupled to first and second angle encoders 52 and 54. The first and second rotation stages 44,46 are respectively coupled to first and second kinematic mounts 40 and 42 which, in turn, are respectively coupled to and provide support for the first outer crystal 21 and the second inner crystal 25. The first and second piezo-inchworms 48 and 50 drive the first and second rotation stages 44 and 46, respectively, for rotationally displacing the first and second crystals 21, 25 relative to one another in tuning the monochromator to a given energy, or bandwidth. The first and second angle encoders 52 and 54 respectively coupled to the first and second rotation stages 44 and 46 provide an accurate indication, or read-out, of the angular position, or orientation, of the two crystals. This arrangement provides an angular resolution of 0.036 arc seconds and an accuracy of on the order of 0.5 arc seconds for each of the first and second crystals 21, 25. Heidenhain model ROD-800 angle encoders are used in the disclosed embodiment. In addition to problems of creep, hysteresis, and the cumulative nature of stepping irregularities in the motion of the first and second inchworms 48, 50, the effects on the Bragg angles due to variations in monochromator-crystal temperature were taken into consideration. Thus, the first and second inchworms 48, 50 are controlled dynamically by software feedback using angle information from the first and second angle encoders 52, 54 and temperature information from a pair of precision thermistors 58 and 60 respectively in contact with the first outer and second inner crystals 21 and 25. The first and second angle encoders 52, 54 are respectively coupled to first and second rotation position indicators 62 and 64.

Given adequate feedback control, the performance of monochromator 20 depends critically on mechanical control over three sources of error and the relative angular orientation of the first outer and second inner crystals 21 and 25: (1) The relative orientation of the first and second angle encoders 52, 54; (2) the precision of these two encoders; and (3) the coupling provided by the first and second kinematic mounts 40 and 42 between these crystals and the encoders. To minimize relative motion of the first and second angle encoders 52, 54, the monochromator support frame 56 is fabricated entirely of stainless steel, welded into a unitary piece, stress relieved by heat treatment, and mounted on a vibration-isolated table (not shown for simplicity). The two other sources of error are interdependent: encoder precision depends in part upon the degree to which the encoder shaft is isolated from external forces, and the flexible coupling that can provide this isolation can also introduce hysteresis (shaft windup) in the crystal-encoder connection. In the disclosed embodiment, this connection is made with a Heidenhain model K-15 rotational coupler in the first and second rotation stages 44 and 46. A tilt stage 66 is provided intermediate the second rotation stage 46 and the second kinematic mount 42 as shown in FIG. 3. Tilt stage 66 allows for tilting the first crystal 21 relative to the second crystal 25 to facilitate alignment of the crystals during set-up.

Figure 6:
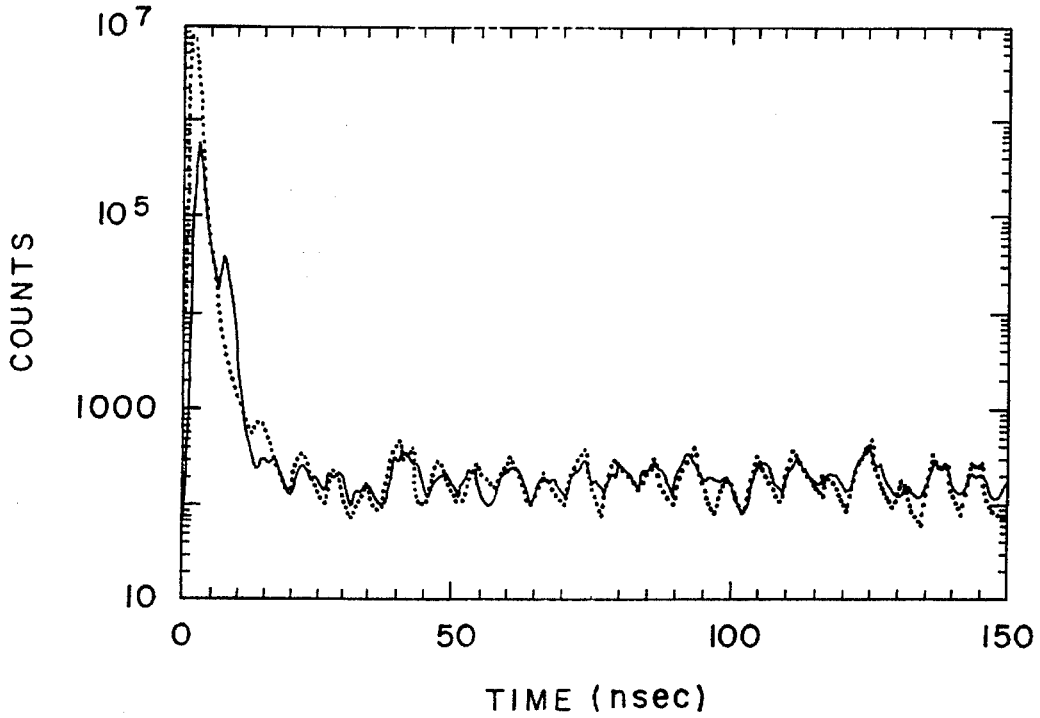
FIG. 6 is a graphic illustration of the resonant time response of YIG(002) reflection at E=14.4 keV.

Due to the long lifetime, t=98 ns, of the 14.413 keV resonance in $^{57}$Fe when compared to the scattering time for the non-resonant radiation, it is possible to time filter the delayed resonant photons from the prompt non-resonant photons. This can be achieved as long as the non-resonant scattering does not saturate the detector. In order to ensure this, the YIG(002) reflection which is nuclear allowed, but electronically forbidden was used to suppress the non-resonant radiation by a factor of $10^6$, or so. From this, a time spectrum without the high resolution monochromator 20 of the present invention was obtained and is shown in FIG. 6. An enormous prompt peak occurs as shown in FIG. 6 despite the six orders of magnitude suppression induced by the electronically forbidden reflection.

Figure 7:
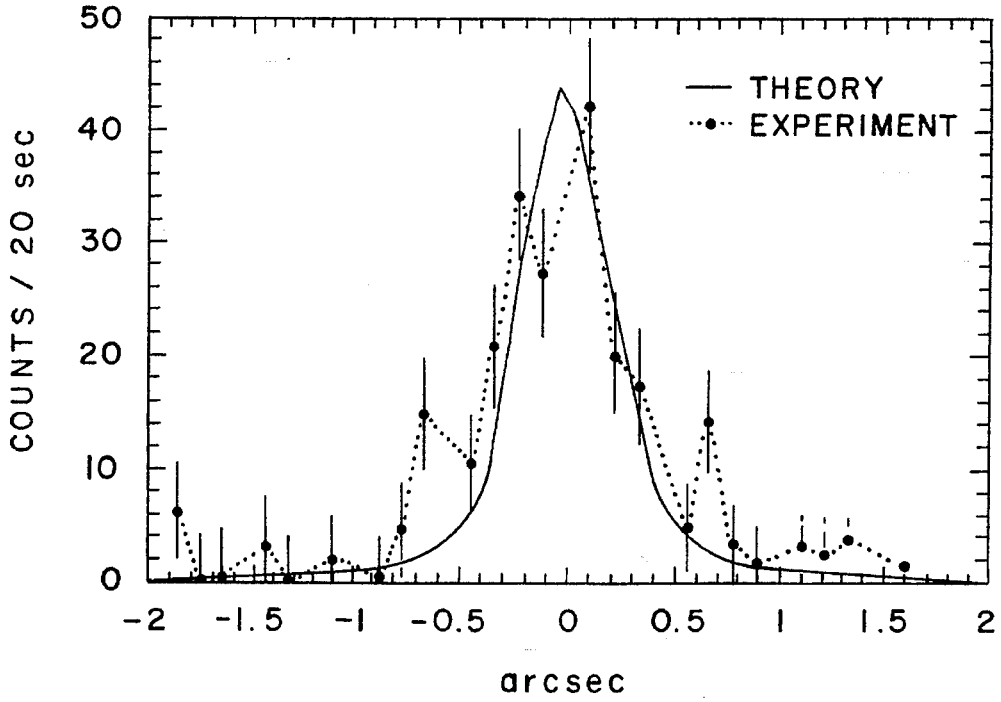
FIG. 7 is a graphic illustration of a rocking curve of Si(10 6 4) against asymmetrically cut Si(4 2 2) measured using Mossbauer (14.413 keV) photons.

Highly monochromatic ($\Delta E/E \approx 10^{-11}$), delayed photons were used to characterize the energy resolution of the high energy resolution, high angular acceptance crystal monochromator 20 of the present invention. To measure the energy bandpass, the inner symmetrical cut silicon crystal 25 (10 6 4) was placed in position and allowed to collect resonant quanta as a function of its rocking angle with the (4 2 2) channel cut remaining fixed. This produced the rocking curve shown in FIG. 7 from which a full width half maximum (FWHM) of 0.7±0.1 arc seconds can be obtained. Transforming this measured FWHM into energy coordinates results in an energy FWHM of 10.8 (±1.6) meV. The full energy bandwidth will be slightly larger than this. The theoretical simulation of this rocking curve involved dispersively convolving the square of the exiting Darwin-Prins curve for the asymmetrically cut (4 2 2) channel cut with that of the symmetrically cut (10 6 4) channel cut. From this a theoretical FWHM of 0.59 arc seconds was obtained.

There has thus been shown a 4-bounce dispersive crystal monochromator comprised of an inner symmetrically cut silicon crystal and an outer asymmetrically cut silicon crystal arranged in a nested configuration, with each crystal including a channel cut so as to provide a pair of inner reflecting surfaces. The asymmetrical channel cut outer crystal affords a low order of reflection while providing for the collimating of the diverging x-rays, while the symmetrically cut inner crystal provides high order reflection for reducing the energy bandpass. Compactness and high resolution are achieved by combining the asymmetrically and symmetrically cut crystal in a novel nested geometry, so that the incident x-ray beam is collimated by the asymmetrically cut crystals before high order reflection. The inventive monochromator affords 0.01 eV energy resolution for x-rays at 14,400 eV (or 0.05 eV at 23,870 eV) while maintaining an angular acceptance of 27 microradians. The x-rays monochromatized by the inventive monochromator have an energy resolution better than one part per million.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

The embodiments of the invention in which an exclusive property or privilege is claimed are defined as follows:

1. A monochromator for limiting the bandpass of radiation comprising:

a first asymmetrical silicon crystal having low order reflection and including first and second spaced, facing, inner surfaces defined by a first channel therein, wherein said first silicon crystal is adapted to receive and collimate diverging radiation incident on the first surface thereof;

a second symmetrical silicon crystal disposed intermediate the first and second inner surfaces of said first silicon crystal and having third and fourth spaced, facing inner surfaces defined by a second channel therein, wherein said incident radiation on the first surface of said first silicon crystal is reflected onto the first and second surfaces of said second silicon crystal and thence onto the second surface of said first silicon crystal, and wherein radiation reflected by the second surface of said first silicon crystal from said second silicon crystal has a bandwidth less than a bandwidth of the incident radiation; and supporting means including first and second rotation stages respectively coupled to and supporting said first and second silicon crystals for maintaining said crystals in fixed relative position and orientation during operation while permitting changes in the relative position and orientation of said crystals, wherein each of said rotation stages includes, in combination, a respective piezo inchworm drive angle encoder and kinematic mount coupled to and supporting a respective crystal for rotationally displacing and providing an indication of the relative angular orientation of said first and second crystals.

2. The monochromator of claim 1 wherein first silicon crystal is a (4 2 2) crystal and said second silicon crystal is a (10 6 4) crystal.

3. The monochromator of claim 2 wherein said first and second crystals form a (+m, +n, −n, −m) crystal arrangement.

4. The monochromator of claim 3 wherein said first and second crystals are cut in an angle $\delta$ relative to their respective diffracting planes, where $\delta=20°$.

5. The monochromator of claim 1 further comprising a tilt stage coupled to one of said crystals for tilting one crystal relative to the other in facilitating alignment of said crystals.

6. The monochromator of claim 1 further comprising first and second thermisistors respectively attached to said first and second crystals and coupled to a respective inchworm drive for compensating for variations in temperature in the monochromator.

7. The monochromator of claim 1 further comprising a unitary support frame coupled to said first and second rotation stages.

* * * * *